US006358063B1

(12) United States Patent
Neidich

(10) Patent No.: US 6,358,063 B1
(45) Date of Patent: Mar. 19, 2002

(54) SEALED INTERPOSER ASSEMBLY

(75) Inventor: Douglas A. Neidich, Harrisburg, PA (US)

(73) Assignee: InterCon Systems, Inc., Harrisburg, PA (US)

( * ) Notice: Subject to any disclaimer, the term of this patent is extended or adjusted under 35 U.S.C. 154(b) by 0 days.

(21) Appl. No.: 09/604,866

(22) Filed: Jun. 28, 2000

(51) Int. Cl.[7] ..... H01R 12/00
(52) U.S. Cl. ..... 439/66; 439/271; 439/272
(58) Field of Search ..... 439/66, 71, 271, 439/272, 559

(56) References Cited

U.S. PATENT DOCUMENTS

| | | | | |
|---|---|---|---|---|
| 3,917,370 A | * | 11/1975 | Thornton et al. | 439/271 |
| 4,529,257 A | | 7/1985 | Goodman et al. | 339/94 |
| 4,593,961 A | | 6/1986 | Cosmo | 339/61 M |
| 4,643,499 A | | 2/1987 | Mitchell | 339/17 CF |
| 4,699,593 A | | 10/1987 | Grabbe et al. | 439/71 |
| 4,743,080 A | * | 5/1988 | Siraty | 439/271 |
| 4,917,620 A | * | 4/1990 | Samejima et al. | 439/272 |
| 5,100,335 A | * | 3/1992 | Yamamoto | 439/271 |
| 5,268,814 A | | 12/1993 | Yakubowski | 361/704 |
| 5,464,355 A | | 11/1995 | Rothenberger | 439/559 |
| 5,528,462 A | * | 6/1996 | Pendse | 439/71 |
| 5,618,204 A | | 4/1997 | Nix et al. | 439/559 |
| 5,713,744 A | | 2/1998 | Laub | 439/71 |
| 5,820,389 A | * | 10/1998 | Hashiguchi | 439/66 |
| 5,879,178 A | * | 3/1999 | Koumatsu et al. | 439/271 |

OTHER PUBLICATIONS

InterCon Systems, Inc. Drawing 7162—Three sheets before Jun. 28, 2000.

* cited by examiner

*Primary Examiner*—Tho D. Ta
(74) *Attorney, Agent, or Firm*—Thomas Hooker, P.C.

(57) ABSTRACT

An interposer assembly for forming electrical connections between opposed pairs of circuit members includes a plate and metal contacts for electrically connecting the circuit members. A gasket surrounds the plate and sealingly abuts the circuit members when the interposer assembly is sandwiched between the circuit members.

12 Claims, 5 Drawing Sheets

SEALED INTERPOSER ASSEMBLY

FIELD OF THE INVENTION

The invention relates to interposer assemblies used for forming electrical connections between spaced contact pads on circuit members.

BACKGROUND OF THE INVENTION

Interposer assemblies form electrical connections between densely spaced contact pads on adjacent parallel circuit members. Interposer assemblies are used wherever dense connections are required. The assemblies are particularly well suited for use in electronic devices such as cellular telephones, computers, radios, control circuits and the like. The assemblies enable a reduction in the size and weight of the electronic devices.

The contact pads on the two circuit members are typically arranged in identical patterns. The interposer assembly includes an insulating plate and a plurality of through-contacts carried in the plate and arranged in the same pattern as the pads on the circuit members. Commonly, the circuit members are a circuit board and a ceramic plate carrying integrated circuits. The interposer assembly is sandwiched between the circuit board and the ceramic plate with the contact pads against the top and bottom surfaces of the plate. The contact pads press against the through-contacts, forming electric connections between aligned pairs of pads.

The contact pads must make reliable, low resistance electrical connections with the through-contacts. The contact pads are conventionally made from a nickel or copper alloy substrate with a thin protective plating. The plating may be thin and allow corrosion of the underlying contact pad. Corrosion products accumulate on the outer surfaces of the contact pads and increase the contact resistance between the pads and the through-contacts.

The protective plating may be a film of corrosion-resistant metal such as gold, silver or platinum. The film is typically 3 to 8 millionths of an inch thick. The plating covers the metal substrate and protects the substrate from corrosion. The plating metal is also an excellent conductor of electricity and reduces contact resistance.

The thin plating film will often contain minute defects such as pores and pinholes. In these areas the film thickness is very thin and the substrate metal is vulnerable to corrosion. The thickness of the plating film must be sufficient to protect the metal substrate from corrosion despite the film defects. However, providing a thick film is wasteful and expensive.

Electronic devices are often used in corrosive environments such as hot, humid air. The air often carries contaminants, such as chlorides from sea spray or sulfides found in air pollution. The contact pads are exposed to the airborne contaminants. The chlorides or sulfides in the air attack plating defects and can corrode the contact pads.

Thus, there is a need for an improved interposer assembly which protects plated pads from corrosive environments and permits use of thin film plating on pads. The interposer assembly should be compatible with existing circuit designs.

SUMMARY OF THE INVENTION

The invention is improved interposer assembly having a sealing member that surrounds the plate when the interposer assembly is sandwiched between the circuit members. The sealing member is also sandwiched between circuit members and seals the interior of the gasket. The sealing member prevents airborne contaminants from entering the spaces between the plate and circuit members and corroding contact pads.

In a preferred embodiment of the invention, the sealing member is a resilient circumferential gasket. The gasket surrounds the interposer plate and includes circumferential top and bottom sealing portions that extend beyond the top and bottom sides of the plate. When the interposer assembly is sandwiched between the circuit members, the gasket is compressed between them. The gasket sealing portions abut the circuit members and seal the interior of the assembly against contaminants.

The plate includes mounting ears that extend away from the plate and support the plate on a frame. The ears extend through slots in the gasket and hold the gasket on the plate. The plate and gasket can be fastened to the frame to form a connection subassembly which is later sandwiched between the circuit members.

The improved interposer assembly of the present invention can be incorporated into existing interposer assemblies. The assemblies can be used in corrosive environments to prevent exposure of contact pads to contaminants. The contact pads do not need to be heavily plated. Thin plating films may be used, with resultant cost savings.

Other objects and features of the invention will become apparent as the description proceeds, especially when taken in conjunction with the accompanying drawings illustrating the invention, of which there are five sheets of drawings and one embodiment.

DESCRIPTION OF THE PREFERRED EMBODIMENT

Figure 1:
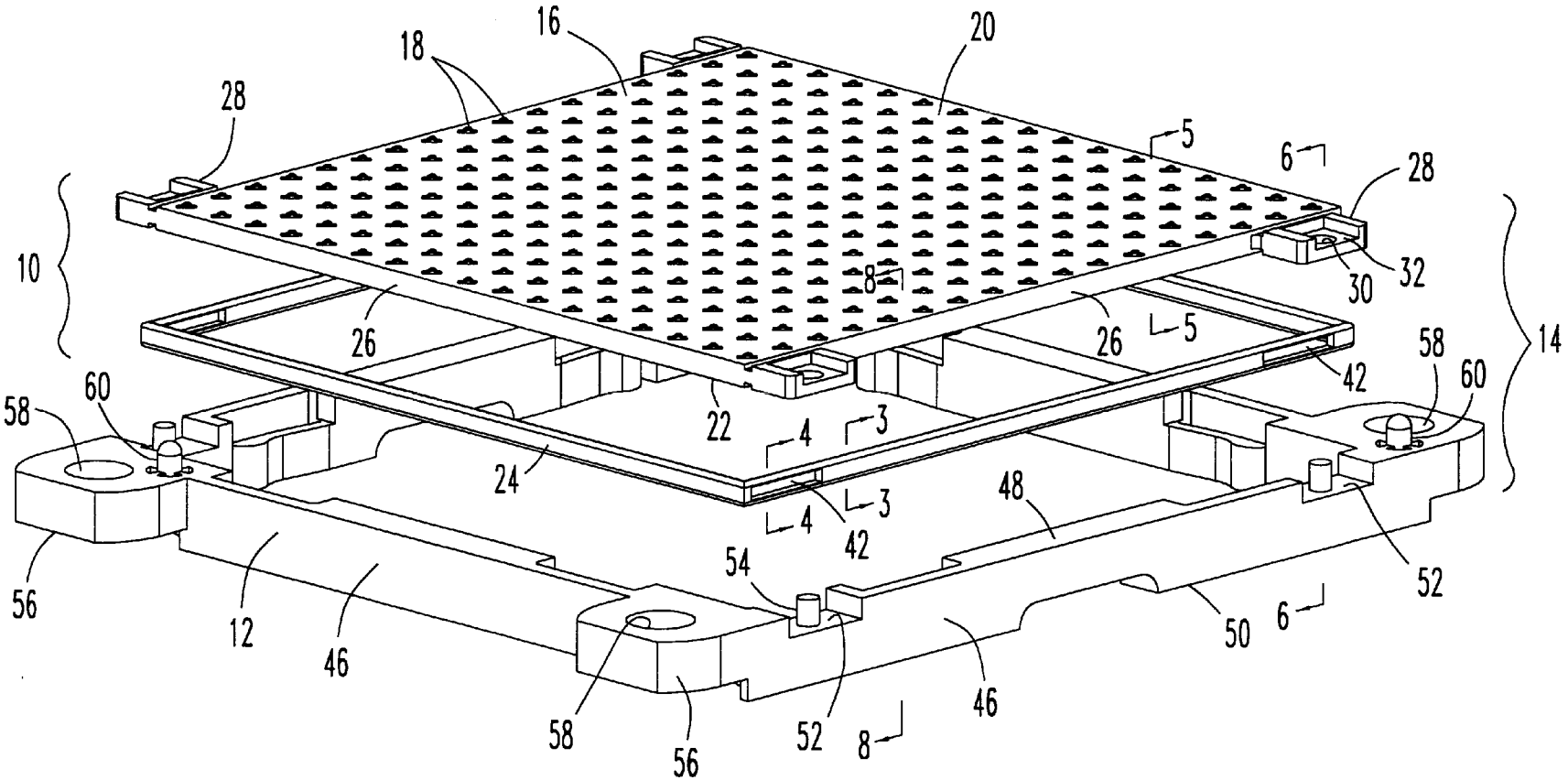
FIG. 1 is an exploded perspective view of an interposer assembly of the present invention and a frame.

FIGS. 1–5 illustrate an interposer assembly 10 in accordance with the present invention. The interposer assembly 10 is mounted in a conventional frame 12 to form a connection subassembly 14.

The interposer assembly 10 includes a rectangular plate 16 formed of insulating material with a plurality of metal through contacts 18 held in the plate and extending between top and bottom plate sides 20 and 22. A resilient circumferential sealing member or gasket 24 surrounds the entire outer periphery of the plate 16. The gasket 24 is preferably formed from a silicone rubber elastomer.

The plate 16 includes four straight outer circumferential walls 26 that extend from the top side 20 to the bottom side 22. Four mounting ears 28 extend outwardly from opposed walls 26 at corners of the plate 16. Each ear 28 includes a through mounting hole 30 that extends from the bottom of the ear to an open cavity 32 in the top of the ear.

Figure 5:
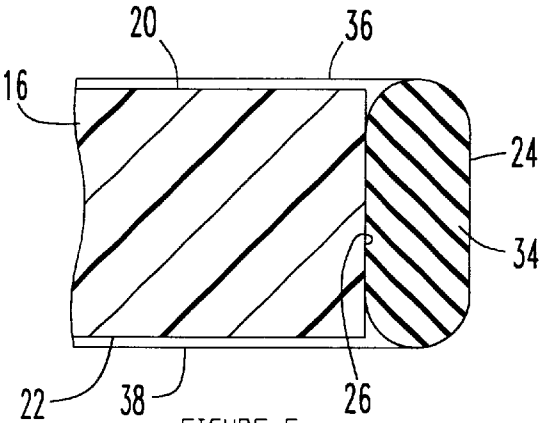
FIG. 5 is a partial sectional view of the interposer assembly taken along line 5—5 of FIG. 1.
Figure 4:
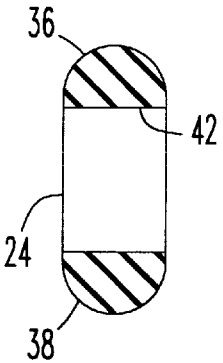
FIG. 4 is a sectional view similar to FIG. 3 but taken along line 4—4 of FIG. 1.
Figure 3:
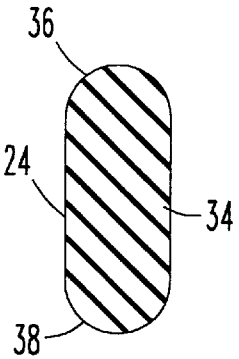
FIG. 3 is a sectional view of the gasket taken along line 3—3 of FIG. 1.

Gasket 24 has a central four-sided body 34 with rounded top and bottom gasket sealing portions 36 and 38 on the top and bottom of the body. The gasket body 34 surrounds and is supported on the plate walls 26. The gasket body 34 does not extend the entire height of the plate walls 26 so that the upper and lower ends of the walls 26 are spaced from the gasket 24. The height of the gasket between the top and bottom sides is greater than the thickness of the plate 16. The gasket sealing portions 36 and 38 extend beyond the top and bottom sides of the plate when the gasket 24 is centered on the walls 26 as shown in FIG. 5.

The mounting ears 28 extend through slots 42 formed in the gasket body 34. See FIG. 6. Grooves 44 are formed on the top and bottom of each ear 28 at the adjacent plate wall. The gasket 24 at the slots 42 is in the grooves 44. The sides of the gasket fit snugly on the ears 28 and center the gasket 24 on the plate. The ears 28 retain the gasket 24 on the plate in position to engage the circuit members.

The circumference of the gasket body 34 is slightly less than the circumference of the outer plate walls 26 when the gasket is unstressed. Gasket 24 is stretched slightly when placed around the plate 16. The resiliency of the gasket 24 presses the gasket body 34 against the walls 26 of the plate 16 and assures the gasket 24 is in proper position on the plate to engage the circuit members. The slots 42 are sized to enable the gasket 24 to elastically expand and accommodate the mounting ears when the gasket is mounted on the plate.

The frame 12 is a hollow rectangular body that receives the interposer assembly 10 and includes four side walls 46 having top and bottom sides 48 and 50. Two pairs of recesses 52 open to the top side 48 are formed on opposing pairs of side walls 46 with mounting pins 54 extending from the base of the recesses towards the top side 48. Frame mounting ears 56 extend outwardly from the corners of the frame and include through mounting holes 58. Diagonally opposed locater posts 60 are located adjacent a diagonal pair of the mounting holes 58.

Figure 2:
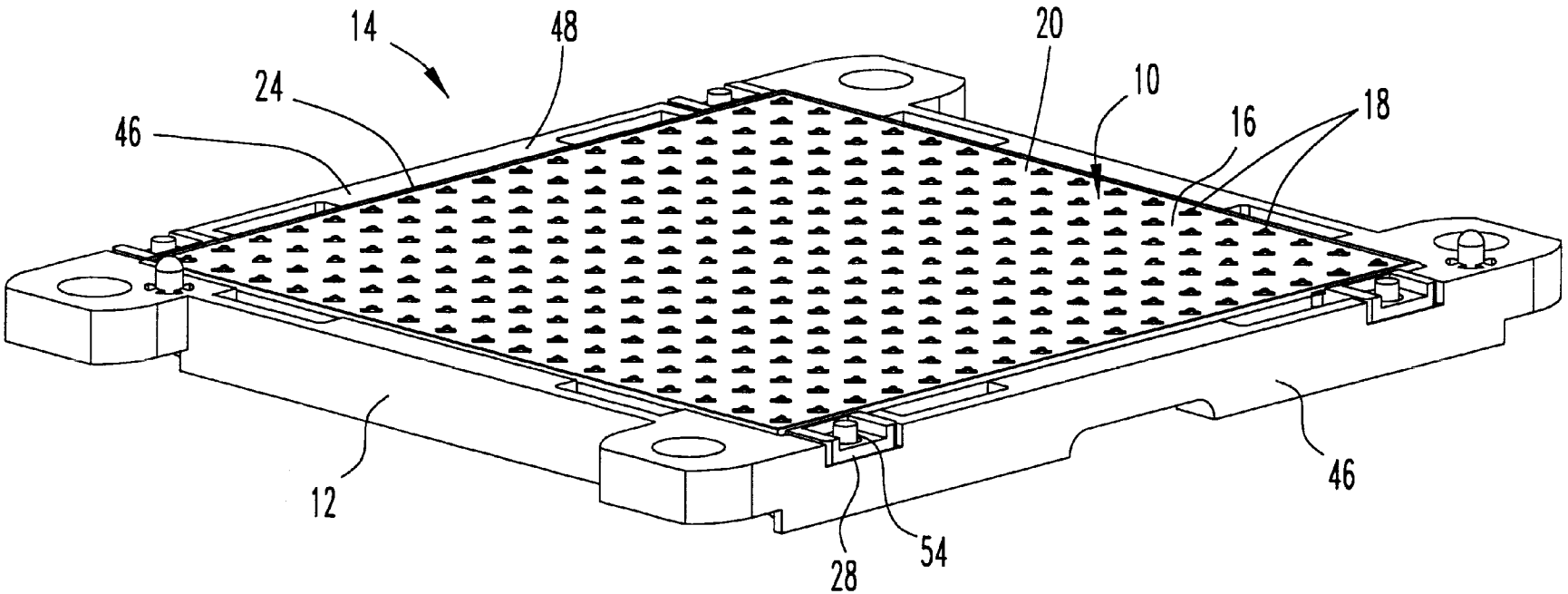
FIG. 2 is a perspective view of the interposer assembly mounted on the frame.

FIG. 2 illustrates the interposer assembly 10 mounted in the frame 12 prior to being permanently fastened to the frame. The plate mounting ears 28 are received in the frame recesses 52 and support the interposer assembly 10 on the frame side walls 46. The top side 20 of the plate 16 is level with the top side of the frame 12. The mounting pins 54 extend through the holes 30 and position the interposer assembly 10 in the frame with the gasket 24 spaced inwardly a short distance from the interior of the facing frame side walls 46. The gasket upper sealing portion 36 extends above the frame 12 and the gasket lower sealing portion 38 is located within the frame 12.

After mounting the interposer assembly 10 in the frame 12, the free ends of the mounting pins 54 are deformed and mushroomed over the mounting ears 28. The mushroomed ends of the pins 54 form heads 62 (see FIG. 6) that permanently hold the interposer assembly 10 to the frame 12 to form connector subassembly 14.

Connection subassembly 14 may be used for forming electrical connections between contact pads on a ceramic integrated circuit and contact pads of a circuit board. The subassembly may also be used for forming electrical connections between other types of contact members or other types of circuit members.

Figure 6:
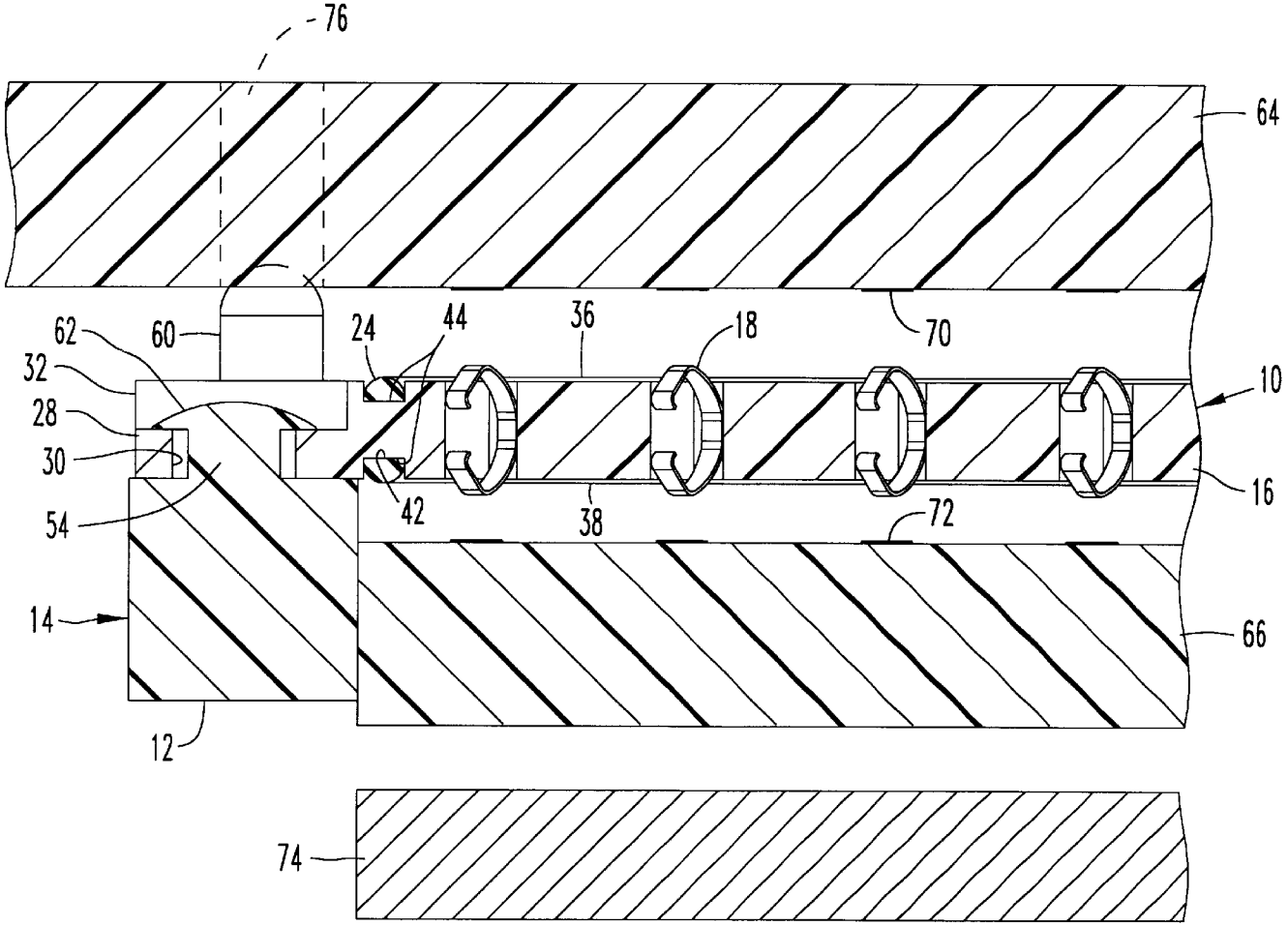
FIG. 6 is a partial sectional view of the interposer assembly and frame prior to being sandwiched between the circuit members taken along line 6—6 of FIG. 1.

FIG. 6 illustrates the connector subassembly 14 positioned between upper and lower circuit members 64 and 66 prior to being sandwiched between the circuit members. The circuit members 64 and 66 include a number of opposed pairs of contact pads 70 and 72 mounted on outer surfaces of the circuit members. The circuit members will be pressed together by a pressure plate 74, which can be a component of a conventional clamp used to clamp circuit members together. The clamp can include tension members (not shown) that extend through frame mounting holes 58.

In this embodiment, the plate 16 and contacts 18 form electrical connections between directly opposed pairs of contact pads. The individual contacts 18 extend outwardly from both sides 20 and 22 of the plate 16 to engage and form electrical connections between opposed pairs contact pads 70 and 72. In other embodiments, the plate and contacts can form electrical connections with other arrangements of opposed contact pads and the contacts can form electrical connections between a different number of contact pads. Different types of plates, contact passages and contacts can be used.

The lower circuit member 66 is received within close-fitting frame 12 from the bottom side of the frame to align the contact pads 72 with the contacts 18. The upper circuit member 64 extends beyond the connector subassembly 14. Locator holes 76 in the circuit member 64 receive locator posts 60 of the frame 12 and align the contacts 18 with the contact pads 70. The circuit members 64 and 66 are spaced away from the interposer assembly 10 and the contacts 18 and gasket 24 are not compressed.

Figure 7:
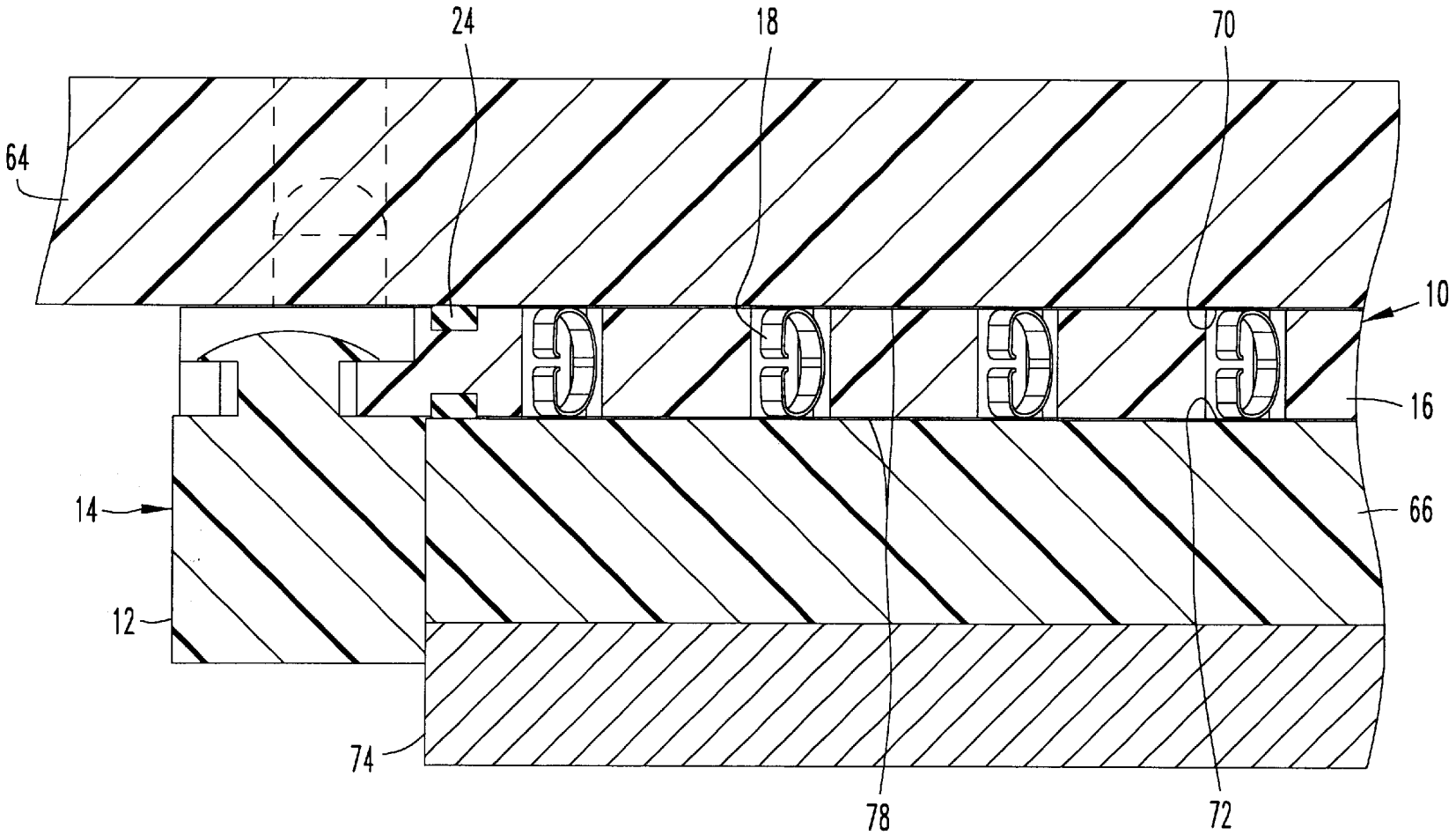
FIG. 7 is a view like FIG. 6 but showing the interposer assembly and frame sandwiched between the circuit members.

FIG. 7 illustrates the connector assembly 14 fully sandwiched between circuit members 64 and 66. Circuit members 64 and 66 are clamped tightly against the plate 16 by pressure plate 74. When the members are brought toward interposer assembly 10, the two sets of contact pads 70 and 72 are moved together and compress the contacts 18 to make low resistance pressure electrical connections between the contacts and the contact pads. The contact pads 70 and 72 abut the top and bottom sides of the plate 16 and support the circuit members against the plate.

Figure 8:
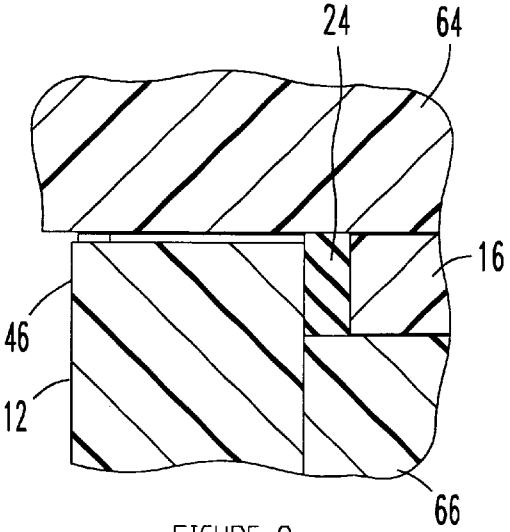
FIG. 8 is a view like FIG. 7 but taken along line 8—8 of FIG. 1.

The circuit members 64 and 66 abut the top and bottom sealing portions 36 and 38 respectively of the gasket 24 and compress the gasket 24 between them. The gasket 24 is compressed to a height equal to the distance between the circuit members. The compressed gasket 24 substantially fills the space between the plate 16 and the frame 12 to prevent contaminants from entering the narrow space between the plate and the circuit members. See FIG. 8. The gasket sealing portions 36 and 38 deform and press against the circuit members to form an air tight seal between the gasket and the circuit members.

The gasket sealing portions 36 and 38 are preferably rounded to provide space between them and the plate when the gasket is not compressed. The rounded gasket sealing portions bulge laterally as the gasket is sandwiched between the circuit members but do not bulge over the top or bottom of the plate. If the sealing portions bulged over the top or bottom of the plate, the gasket will be captured between the plate and a circuit member. The circuit member will not seat properly against the plate and the contacts may not make reliable electrical connections with the contact pads. The rounded ends provide sufficient space for the gasket to compress without being captured between a circuit member and the plate.

The interior of the gasket is sealed from the outside environment by the gasket, the circuit members and the air tight seals between the gasket and the circuit members. The sets of contact pads 70 and 72 and the interposer contacts 18 are located within the sealed interior chamber 78. Contaminants cannot enter the interior of the chamber 78 and corrode the contact pads and the interposer contacts.

The circuit members may move towards and away from each other due to changes in operating temperature, user handling of the device, or the like. The gasket is compliant and can expand and contract to maintain sealing contact with the circuit members despite the relative movement of the circuit members.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention:

1. An interposer assembly for forming electrical connections between a pair of circuit members, each circuit member having a set of contact pads, the interposer assembly comprising:

a plate having a top surface, a bottom surface spaced the thickness of the plate from the top surface, an outer wall surrounding the plate and extending from the top surface to the bottom surface, and a plurality of ears extending outwardly from the outer wall of the plate, each ear having a thickness adjacent the plate less than the thickness of plate with the ear adjacent the plate located below the plate top surface and above the plate bottom surface, an outer portion located outwardly of the gasket, and a mounting hole extending through such portion;

a plurality of contacts extending through the thickness of the plate for making electrical connections between sets of contact pads; and an elastomeric circumferential gasket surrounding the outer wall of the plate, said gasket having a top circumferential sealing portion adjacent the top of the plate, a bottom circumferential sealing portion adjacent the bottom of the plate, a body located between the top and bottom sealing portions, and a plurality of holes extending through the gasket body between the top and bottom sealing portions, each ear extending through a hole in the gasket with the outer portion and the mounting hole thereof located outwardly from the gasket, said gasket having an uncompressed height greater than the thickness of the plate;

wherein when the interposer assembly is sandwiched between a pair of circuit members the gasket sealingly abuts the circuit members.

2. An interposer assembly as in claim 1 wherein each sealing portion is rounded.

3. An interposer assembly as in claim 1 including a pair of circuit members and a frame, each circuit member having a set of contact pads;

the plate includes four ears extending from the outer wall and the gasket includes four slots, each ear extending through a slot and engaging the frame;

the frame, plate and gasket sandwiched between the circuit members, the contacts electrically connecting the sets of contact pads; and a sealed interior chamber, the sets of contact pads and contacts in the chamber.

4. An interposer assembly as in claim 1 wherein said plate is rectangular and includes four corners, and each ear is located adjacent one of said corners.

5. An interposer assembly as in claim 1 wherein the thickness of each ear adjacent the plate is less than the thickness of the plate.

6. An interposer assembly as in claim 1 wherein each ear has a thickness outwardly of the plate greater than the thickness of the ear adjacent the plate.

7. An interposer assembly for forming electrical connections between a pair of circuit members, each circuit member having a set of contact pads, the interposer assembly comprising:

a plate having a top surface, a bottom surface spaced the thickness of the plate from the top surface, and an outer wall surrounding the plate and extending from the top surface to the bottom surface, said outer wall including retention surfaces that engage a gasket to locate the gasket on the outer wall;

a plurality of contacts extending through the thickness of the plate for making electrical connections between sets of contact pads; and an elastomeric circumferential gasket surrounding the outer wall of the plate, said gasket including a slot, said retention surfaces extending outwardly from the outer wall and into the slot, the retention surfaces located on an ear that extends through the gasket slot and beyond the gasket to mount the interposer assembly on another body.

8. A connector assembly for establishing electrical connections between a pair of circuit members, each circuit member having a set of contact pads, the connector assembly comprising:

an interposer assembly, a frame surrounding the interposer assembly and a connection fastening the interposer assembly to the frame;

the interposer assembly including a plate, a plurality of contacts in the plate for making electrical connections between contact pads, and a gasket surrounding the plate and including circumferential top and bottom seal portions, each seal portion extending completely around the plate, and slots in the gasket; and the connection including mounting ears extending from the plate and through the slots, the ears extending beyond the gasket, and a mounting hole extending through each ear outwardly of the gasket, wherein the ears hold the gasket on the plate, and a plurality of mounting pins on the frame, each mounting pin extending through one of the mounting holes.

9. A connector assembly as in claim 8 wherein the gasket is formed from an elastomeric material and engages the plate, the gasket being elastically stressed.

10. A connector assembly as in claim 8 wherein the plate has opposed first and second sides separated by the thickness of the plate and the gasket extends beyond the sides of the plate when uncompressed.

11. A connector assembly as in claim 8 wherein the gasket is elastically stretched against the plate.

12. A connector assembly as in claim 8 wherein the plate has a thickness, and each ear includes an ear portion adjacent the plate, said portion having a thickness less than the thickness of the plate and located between the top and bottom of the plate.

* * * * *